US006809069B2

(12) United States Patent
Deshimaru et al.

(10) Patent No.: US 6,809,069 B2
(45) Date of Patent: Oct. 26, 2004

(54) LUBRICATING OIL COMPOSITION

(75) Inventors: Junichi Deshimaru, Chiba (JP); Yutaka Takakura, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 10/257,959

(22) PCT Filed: Apr. 27, 2001

(86) PCT No.: PCT/JP01/03725

§ 371 (c)(1),
(2), (4) Date: Oct. 24, 2002

(87) PCT Pub. No.: WO01/83653

PCT Pub. Date: Nov. 8, 2001

(65) Prior Publication Data

US 2003/0158053 A1 Aug. 21, 2003

(30) Foreign Application Priority Data

May 2, 2000 (JP) ..... 2000-133119

(51) Int. Cl.[7] ..... C10M 159/22; C10M 159/24

(52) U.S. Cl. ..... 508/398; 508/390; 508/391; 508/421; 508/460; 508/539; 508/586

(58) Field of Search ..... 508/390, 408, 508/460, 391, 398

(56) References Cited

U.S. PATENT DOCUMENTS

| | | | | | |
|---|---|---|---|---|---|
| 5,750,477 | A | * | 5/1998 | Sumiejski et al. | 508/331 |
| 5,972,854 | A | | 10/1999 | Ichihashi et al. | 508/433 |
| 6,051,536 | A | | 4/2000 | Igarashi et al. | 508/364 |
| 6,103,673 | A | * | 8/2000 | Sumiejski et al. | 508/186 |
| 6,225,266 | B1 | * | 5/2001 | Watts et al. | 508/193 |
| 6,262,000 | B1 | * | 7/2001 | Reeve et al. | 508/371 |
| 6,337,309 | B1 | * | 1/2002 | Watts et al. | 508/291 |
| 6,426,323 | B1 | * | 7/2002 | Sato et al. | 508/371 |
| 6,482,778 | B2 | * | 11/2002 | Tersigni et al. | 508/188 |
| 6,617,286 | B2 | * | 9/2003 | Sato et al. | 508/192 |
| 6,730,640 | B2 | * | 5/2004 | Sowerby et al. | 508/371 |

FOREIGN PATENT DOCUMENTS

| | | |
|---|---|---|
| EP | 798367 | 10/1997 |
| EP | 805194 | 11/1997 |
| JP | 3-47898 | 2/1991 |
| JP | 9-78079 | 3/1997 |
| JP | 10-306292 | 11/1998 |
| JP | 11-293272 | 10/1999 |
| JP | 2000-63878 | 2/2000 |
| JP | 2000-319682 | 11/2000 |

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

A lubricating oil composition which comprises a lubricating base oil and a sulfonate, phenate or salicylate of an alkaline earth metal and has a friction coefficient between metals of 0.12 or higher at −20° C. as measured in accordance with a block-on-disk test. The friction coefficient between metals in the use of a metal belt can be kept high within a wide range of temperature from low temperatures to high temperatures. In particular, the lubricating oil exhibits a high performance of $\mu$=0.12 or higher at a low temperature of −20° C. in accordance with a block-on-disk test.

6 Claims, 1 Drawing Sheet

LUBRICATING OIL COMPOSITION

TECHNICAL FIELD

The present invention relates to a lubricating oil composition and, more particularly, to a lubricating oil composition for a continuously variable transmission of the metal belt type which exhibits a high friction coefficient between metals within a wide range of temperature from low temperatures to high temperatures.

BACKGROUND ART

Improvement in the fuel economy of automobiles is an important subject in recent years from the standpoint of the global environment. The continuously variable transmission of the metal belt type (hereinafter, abbreviated as a belt CVT) which is more efficient than conventional multistage automatic transmissions (AT) is being used in an increasingly greater number of automobiles. The belt CVT is used in automobiles having a wide range of displacement from 0.66 liters to 2.5 liters. The greater the displacement, the greater the required capacity of torque transfer of the metal belt, i.e., the higher the required friction coefficient between metals. On the other hand, there is the tendency that the use of the belt CVT increases worldwide and it is expected that the belt CVT will be used in a wide range of temperature from low temperatures to high temperatures. Therefore, it is desired that a lubricating oil for the belt CVT exhibits a high friction coefficient between metals in the wide range of temperature.

Investigations on the improvement of a lubricating oil for a belt CVT with respect to the friction coefficient between metals have heretofore been conducted only under conditions of high temperatures (Japanese Patent Application Laid-Open Nos. Heisei 11(1999)-92779, Heisei 11(1999)-293272 and 2000-1687) and no investigations are found on the improvement of the friction coefficient between metals at a low temperature such as several ten degrees Celsius below zero. Actually, when the friction coefficient between metals ($\mu$) was measured using commercial lubricating oils for a belt CVT in accordance with the block-on-disk test, the highest values obtained were $\mu$=0.138 at 100° C. and $\mu$=0.108 at −20° C. Thus, it was found that the friction coefficient between metals decreased extremely at low temperatures.

DISCLOSURE OF THE INVENTION

The present invention has an object of overcoming the drawback of the above conventional technology and providing a high performance lubricating oil exhibiting a friction coefficient between metals in the use of a metal belt of $\mu$=0.12 or higher at −20° C.

As the result of intensive studies by the present inventors to overcome the above drawback, it was found that, although zinc dithiophosphate is used for improving the friction coefficient between metals in conventional lubricating oils for a belt CVT having a high friction coefficient between metals at 100° C., the lubricating oil containing zinc dithiophosphate exhibited a great decrease in the friction coefficient between metals at low temperatures and the friction coefficient at the temperature of −20° C. could not be increased to a value of 0.12 or higher and that it was necessary that a novel additive which could increase the friction coefficient between metals at low temperatures be added to overcome the above drawback.

As the result of further studies by the present inventors, it was found that the above object could be achieved by adding a sulfonate, phenate or salicylate of an alkaline earth metal in a specific amount or more. The present invention has been completed based on this knowledge.

The present invention provides a lubricating oil composition which comprises a lubricating base oil and a sulfonate, phenate or salicylate of an alkaline earth metal and has a friction coefficient between metals of 0.12 or higher at −20° C. as measured in accordance with a block-on-disk test.

THE MOST PREFERRED EMBODIMENT TO CARRY OUT THE INVENTION

Figure 1:
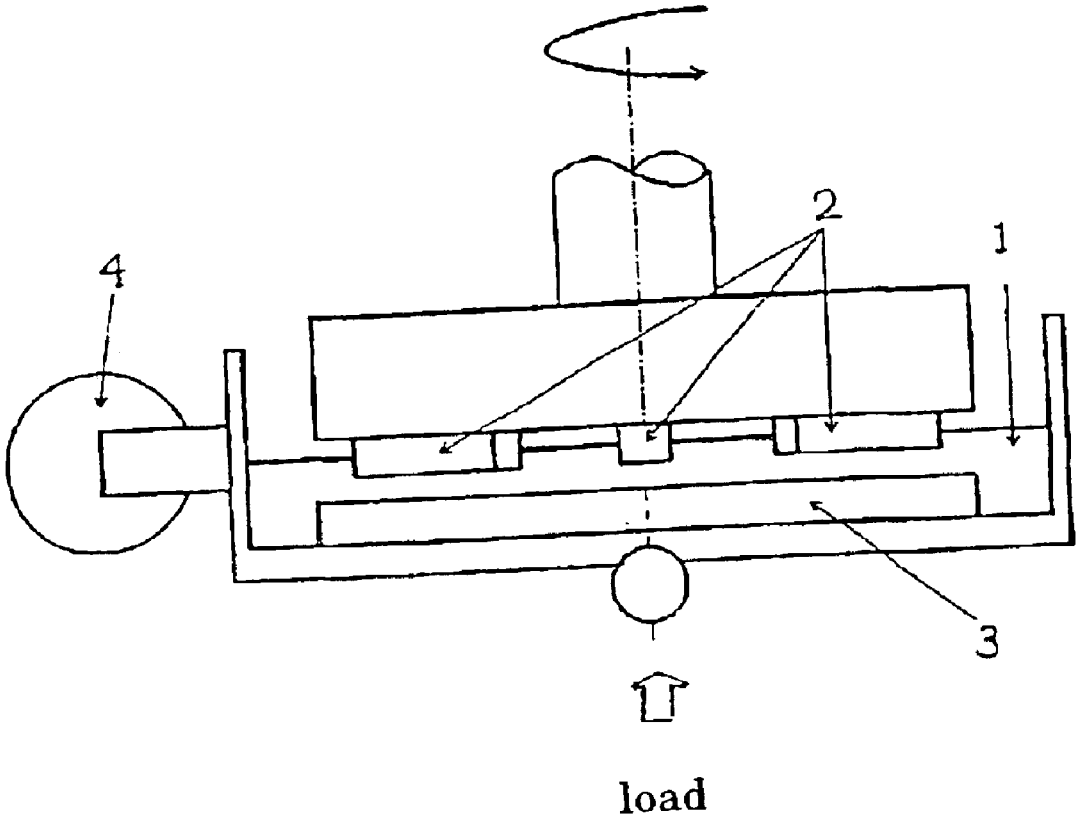
FIG. 1 shows a schematic sectional view exhibiting a block-on-disk tester used for the measurement of the friction coefficient between metals in Examples of the present invention and Comparative Examples.

The present invention will be described in detail in the following.

The base oil in the lubricating oil composition of the present invention is not particularly limited. Any oil including mineral oil and synthetic oil can be used as long as the oil can be used as an automatic transmission fluid (ATF) or a continuously variable transmission fluid (CVTF).

Examples of the mineral oil include paraffinic mineral oils, intermediate mineral oils and naphthenic mineral oils. Specific examples of the mineral oil include light neutral oil, intermediate neutral oil, heavy neutral oil and bright stock.

Examples of the synthetic oil include polybutene; polyolefins including homopolymers and copolymers of α-olefins such as ethylene-α-olefin copolymers; various types of esters such as polyol esters, esters of dibasic acids and esters of phosphoric acid; various types of ethers such as polyphenyl ethers; polyglycols; alkylbenzenes; and alkylnaphthalenes. Among these synthetic oils, polyolefins and polyol esters are preferable.

In the present invention, as the base oil, the above mineral oil may be used singly or in combination of two or more and the above synthetic oil may be used singly or in combination of two or more. One or more types of the above mineral oil and one or more types of the above synthetic oil may also be used in combination as the base oil.

The lubricating oil composition of the present invention comprises, as described above, a sulfonate, phenate or salicylate of an alkaline earth metal.

The sulfonate, phenate and salicylate of an alkaline earth metal work as the metal-based detergent. Examples of the above compound include calcium sulfonate, calcium phenate, calcium salicylate, magnesium sulfonate and barium sulfonate. The above compound may be used singly or in combination of two or more. The sulfonate, phenate and salicylate of an alkaline earth metal may be compounds formed into perbases with a hydroxide or carbonate of an alkaline earth metal. A salt of an alkaline earth metal having a low base number of 10 to 100 mg KOH/g and a salt of an alkaline earth metal having a high base number of 100 to 500 mg KOH/g may be used singly or in combination, the base number being measured in accordance with the perchloric acid method.

As for the amount of the sulfonate, phenate or salicylate of an alkaline earth metal in the lubricating oil composition, when the amount of the above compound is excessively small, occasionally, the friction coefficient between metals at low temperatures cannot be increased sufficiently and the object of the present invention cannot be achieved sufficiently. When the amount of the above compound is excessively great, the wear resistance of the metal occasionally deteriorates. Therefore, it is preferable that the above compound is comprised in an amount such that the amount of the metal is in the range of 1,000 ppm by weight or more and more preferably in the range of 1,500 to 3,500 ppm by weight.

The lubricating oil composition of the present invention may further comprise a phosphorus-based compound. It is preferable that the amount of the phosphorus-based compound is 100 ppm by weight or less so that the object of the present invention is not adversely affected.

Examples of the phosphorus-based compound include ester compounds of phosphoric acid and ester compounds of phosphorous acid. Specific examples of the phosphorus-based compound include aliphatic esters of phosphoric acid such as tributyl phosphate, tri-2-ethylhexyl phosphate and tributoxy phosphate; aromatic esters of phosphoric acid such as tricresyl phosphate, triphenyl phosphate, trixylenyl phosphate, cresyl diphenyl phosphate and 2-ethylhexyl diphenyl phosphate; acidic esters of phosphoric acid such as mono- and di-butyl acid phosphate, mono- and di-2-ethylhexyl acid phosphate, mono- and di-isodecyl acid phosphate, mono- and di-lauryl acid phosphate, mono- and di-oleyl acid phosphate and amine salts of these compounds; aliphatic esters of phosphorous acid such as tributyl phosphite, trioctyl phosphite, trisdecyl phosphite, tristridecyl phosphite and trioleyl phosphite; aromatic esters of phosphorous acid such as triphenyl phosphite, tricresyl phosphite, trisnonylphenyl phosphite, diphenyl mono-2-ethylhexyl phosphite and diphenyl monotridecyl phosphite; aliphatic hydrogenphosphites such as dibutyl hydrogenphosphite, di-2-ethylhexyl hydrogenphosphite, dilauryl hydrogenphosphite and dioleyl hydrogenphosphite; aromatic hydrogenphosphites such as diphenyl hydrogenphosphite and dicresyl hydrogenphosphite; and phosphorus compounds having sulfur such as triphenol phosphorothionate, trisnonylphenyl phosphorothionate, trilauryl thiophosphite, S-octyl thioethyl hydrogenphosphite and S-dodecyl thioethyl hydrogenphosphite. The above compound may be used singly or in combination of two or more.

Where desired, the lubricating oil composition of the present invention may further comprise other additives such as dispersants, antioxidants, extreme pressure agents, copper inactivators, friction modifiers, defoaming agents and viscosity index improvers as long as the object of the present invention is not adversely affected. Various types of polymers such as polymethacrylates (PMA) and dispersion type PMA containing nitrogen may also be comprised.

Examples of the dispersant include succinimide compounds and/or boron-based imide compounds. Since these compounds have the property of improving the friction coefficient between metals at high temperatures, it is preferable that these compounds are used in combination with the above salt of an alkaline earth metal.

Examples of the extreme pressure agent include sulfur-based extreme pressure agents. Specific examples of the extreme pressure agent include compounds based on alkyl polysulfides, compounds based on polysulfides having an aromatic group in an alkyl group, compounds based on dithiocarbamate, compounds based on sulfurized oils and fats, compounds based on olefin sulfides and compounds based on thiadiazoles. The above compound may be used singly or in combination of two or more.

Examples of the friction modifier include carboxylic acids, carboxylic acid amides, carboxylic acid esters, oils and fats, alkylamines, partial esters of dibasic acids and alcohols and partial esters of carboxylic acids and polyhydric alcohols.

Due to the above components, the lubricating oil composition of the present invention exhibits a friction coefficient between metals of 0.12 or higher at −20° C. as measured in accordance with the block-on-disk test. Thus, the friction coefficient between metals can be kept high in a wide range of temperature from low temperatures to high temperatures.

In the lubricating oil composition of the present invention, the friction coefficient which is related to the capacity of torque transfer of a metal belt CVT can be kept high in a wide range of temperature from low temperatures to high temperatures. Since the belt CVT has a mechanism such that power is transferred by the friction force between a belt and a pulley, the controlling oil pressure which provides the pushing force between the belt and the pulley can be decreased due to the increased friction force between metals. Therefore, the fuel economy can be improved remarkably and the lubricating oil composition has a great advantage in the application to the belt CVT.

The present invention will be described more specifically with reference to examples in the following. However, the present invention is not limited to the examples.

EXAMPLES 1 TO 10 AND COMPARATIVE EXAMPLES 1 TO 6

Using lubricating oil compositions containing components shown in Table 1, the friction coefficient between metals and the wear resistance were measured in accordance with the methods shown in the following under the conditions shown also in the following. The results are shown in Table 1.

The materials used in Examples and Comparative Examples are as follows:

Base oil: A paraffinic mineral oil

Ca sulfonate having a high base number: Ca sulfonate having a base number of 300 mg KOH/g Ca sulfonate having a low base number: Ca sulfonate having a base number of 40 mg KOH/g Ca salicylate having a high base number: Ca salicylate having a base number of 150 mg KOH/g Ca phenate having a high base number: Ca phenate having a base number of 250 mg KOH/g Mg sulfonate having a high base number: Mg sulfonate having a base number of 300 mg KOH/g Ba sulfonate having a high base number: Ba sulfonate having a base number of 200 mg KOH/g Other Additives:

As the other additives, the same antioxidant, copper inactivator pour point depressant, friction modifier and defoaming agent were contained in the same amounts in all of Examples and Comparative Examples.

(a) Evaluation of the Friction Coefficient Between Metals

The friction coefficient was evaluated using a block-on-disk tester shown in FIG. 1. A sample oil 1 was placed into the block-on-disk tester. A load was applied between three blocks of a sample 2 and a disk 3. The upper portion was rotated and the torque of rotation formed by the friction was detected by a load cell 4. The conditions of the measurement were as follows:

Condition of preliminary operation
Pressure on the surface: 100 MPa
Temperature of oil: 100° C.
Slipping speed: 0.1 m/second
Time: 30 minutes
Measurement of the property
Pressure on the surface: 200 MPa
Temperature of oil: −20° C.
Slipping speed: 0.1 m/second (b) Wear Resistance The wear resistance was measured in accordance with the four-ball test method of ASTM D2266.

TABLE 1

| Example | 1 | 2 | 3 | 4 | 5 |
|---|---|---|---|---|---|
| Composition of components (% by weight) | | | | | |
| base oil | 86.0 | 85.0 | 83.5 | 84.5 | 87.0 |
| PMA | 5.0 | 5.0 | 5.0 | 5.0 | 5.0 |
| metal-based detergent | | | | | |
| Ca sulfonate having high base number | 1.0 | 2.0 | 0.5 | | |
| Ca sulfonate having low base number | | | 3.0 | | |
| Ca salicylate having high base number | | | | 2.5 | |
| Ca phenate having high base number | | | | | 1.5 |
| Mg sulfonate having high base number | | | | | |
| Ba sulfonate having high base number | | | | | |
| no ash dispersant | | | | | |
| succinimide | 5.0 | 5.0 | 5.0 | 5.0 | 5.0 |
| phosphorus-based compound | | | | | |
| tricresyl phosphate | | | | | |
| hydrogen phosphite | | | | | |
| zinc dithiophosphate | | | | | |
| other additives | 3.0 | 3.0 | 3.0 | 3.0 | 3.0 |
| amount of Ca, Mg or Ba (ppm by weight) | 1500 | 3000 | 1290 | 1475 | 1382 |
| amount of P (ppm by weight) | 0 | 0 | 0 | 0 | 0 |
| Property | | | | | |
| friction coefficient between metals (−20° C.) | 0.121 | 0.124 | 0.120 | 0.121 | 0.121 |
| amount of wear (mm) | 0.41 | 0.47 | 0.40 | 0.48 | 0.41 |

| Example | 6 | 7 | 8 | 9 | 10 |
|---|---|---|---|---|---|
| Composition of components (% by weight) | | | | | |
| base oil | 85.5 | 86.0 | 85.8 | 84.9 | 84.9 |
| PMA | 5.0 | 5.0 | 5.0 | 5.0 | 5.0 |
| metal-based detergent | | | | | |
| Ca sulfonate having high base number | | | 0.7 | 2.0 | 2.0 |
| Ca sulfonate having low base number | | | | | |
| Ca salicylate having high base number | | | | | |
| Ca phenate having high base number | | | | | |
| Mg sulfonate having high base number | 1.5 | | 0.5 | | |
| Ba sulfonate having high base number | | 1.0 | | | |
| no ash dispersant | | | | | |
| succinimide | 5.0 | 5.0 | 5.0 | 5.0 | 5.0 |
| phosphorus-based compound | | | | | |
| tricresyl phosphate | | | | 0.1 | |
| hydrogen phosphite | | | | | 0.1 |
| zinc dithiophosphate | | | | | |
| other additives | 3.0 | 3.0 | 3.0 | 3.0 | 3.0 |
| amount of Ca, Mg or Ba (ppm by weight) | 1470 | 2160 | 1540 | 3000 | 3000 |
| amount of P (ppm by weight) | 0 | 0 | 0 | 90 | 60 |
| Property | | | | | |
| friction coefficient between metals (−20° C.) | 0.121 | 0.121 | 0.121 | 0.120 | 0.120 |
| amount of wear (mm) | 0.43 | 0.43 | 0.43 | 0.46 | 0.45 |

| Comparative Example | 1 | 2 | 3 | 4 |
|---|---|---|---|---|
| Composition of components* (% by weight) | A | B | | |
| base oil | | | 85.5 | 86.5 |
| PMA | | | 5.0 | 5.0 |
| metal-based detergent | | | | |
| Ca sulfonate having high base number | | | 0.5 | 0.5 |
| no ash dispersant | | | | |
| succinimide | | | 5.0 | 5.0 |
| phosphorus-based compound | | | | |
| tricresyl phosphate | | | | |
| hydrogen phosphite | | | | |
| zinc dithiophosphate | | | 1.0 | |
| other additives | | | 3.0 | 3.0 |
| amount of Ca, Mg or Ba (ppm by weight) | — | — | 750 | 750 |
| amount of P (ppm by weight) | — | — | 300 | 0 |
| Property | | | | |
| friction coefficient between metals (−20° C.) | 0.101 | 0.108 | 0.112 | 0.111 |
| friction coefficient between metals (100° C.) | — | 0.138 | — | — |
| amount of wear (mm) | 0.42 | 0.40 | 0.41 | 0.42 |

| Comparative Example | 5 | 6 |
|---|---|---|
| Composition of components (% by weight) | | |
| base oil | 85.5 | 85.5 |
| PMA | 5.0 | 5.0 |
| metal-based detergent | | |
| Ca sulfonate having high base number | 1.0 | 1.0 |
| no ash dispersant | | |
| succinimide | 5.0 | 5.0 |
| phosphorus-based compound | | |
| tricresyl phosphate | 0.5 | |
| hydrogen phosphite | | 0.5 |
| zinc dithiophosphate | | |
| other additives | 3.0 | 3.0 |
| amount of Ca, Mg or Ba (ppm by weight) | 1500 | 1500 |
| amount of P (ppm by weight) | 450 | 300 |
| Property | | |
| friction coefficient between metals (−20° C.) | 0.110 | 0.105 |
| friction coefficient between metals (100° C.) | — | — |
| amount of wear (mm) | 0.40 | 0.39 |

Notes:
A Commercial oil A
B Commercial oil B

Industrial Applicability

The lubricating oil composition of the present invention can be used as the lubricating oil composition for continuously variable transmission of the metal belt type which requires a high friction coefficient in a wide range of temperature from low temperatures to high temperatures. Since the belt CVT has a mechanism such that power is transferred by the friction force between a belt and a pulley, the controlling oil pressure which provides the pushing force between the belt and the pulley can be decreased due to the increased friction force between metals. Therefore, the fuel economy can be improved remarkably and the lubricating oil composition has a great advantage in the application to the belt CVT.

What is claimed is:

1. A lubricating oil composition which comprises (1) a lubricating base oil, (2) a sulfonate, phenate or salicylate of an alkaline earth metal in an amount such that an amount of metal is in a range of 1,000 to 3,500 ppm by weight, (3) an ashless dispersant, (4) a phosphorus-based compound, wherein phosphorus is present in an amount of 0 to 100 ppm by weight, and (5) at least one additive selected from the group consisting of dispersant, antioxidant, extreme pressure agent, copper inactivator, pour point depressant, friction modifier, defoaming agent and viscosity index improver, which composition has a friction coefficient between metals of 0.12 or higher at −20° C. as measured in accordance with a block-on-disk test.

2. A lubricating oil composition according to claim 1, wherein the alkaline earth metal in the sulfonate, phenate or salicylate of an alkaline earth metal is a metal selected from a group consisting of calcium, magnesium and barium.

3. A lubricating oil composition according to claim 1, wherein the sulfonate, phenate or salicylate of an alkaline earth metal comprises a salt of an alkaline earth metal having a high base number in a range of 100 to 500 mg KOH/g.

4. A lubricating oil composition according to claim 1, which further comprises a phosphorus-based compound.

5. A lubricating oil composition consisting essentially of (1) a lubricating base oil, (2) a sulfonate, phenate or salicylate of an alkaline earth metal in an amount such that an amount of metal is in a range of 1,000 to 3,500 ppm by weight, (3) an ashless dispersant, (4) a phosphorus-based compound, wherein phosphorus is present in an amount of 0 to 100 ppm by weight, and (5) at least one additive selected from the group consisting of dispersant, antioxidant, extreme pressure agent, copper inactivator, pour point depressant, friction modifier, defoaming agent and viscosity index improver, which composition has a friction coefficient between metals of 0.12 or higher at −20° C. as measured in accordance with a block-on-disk test.

6. A process for operating a continuously variable transmission of a belt type comprising employing the lubricating oil composition according to claim 1 as a lubricant for said transmission.

* * * * *